US010980335B1

(12) United States Patent
Pinholster, Jr. et al.

(10) Patent No.: US 10,980,335 B1
(45) Date of Patent: Apr. 20, 2021

(54) CONVERTIBLE HAMMOCK ASSEMBLY, AND METHOD FOR CONVERTING A FLEXIBLE HAMMOCK TO AN INCLINED FORM

(71) Applicant: Eagles Nest Outfitters, Inc., Asheville, NC (US)

(72) Inventors: Peter G. Pinholster, Jr., Asheville, NC (US); Ryan Klinger, Asheville, NC (US); Bridget Stephas, Asheville, NC (US)

(73) Assignee: Eagles Nest Outfitters, Inc., Asheville, NC (US)

( * ) Notice: Subject to any disclaimer, the term of this patent is extended or adjusted under 35 U.S.C. 154(b) by 366 days.

(21) Appl. No.: 16/002,246

(22) Filed: Jun. 7, 2018

(51) Int. Cl.
*A45F 3/24* (2006.01)

(52) U.S. Cl.
CPC ..... *A45F 3/24* (2013.01)

(58) Field of Classification Search
CPC ..... A45F 3/24; A45F 3/22; A45F 3/26; A61G 1/044; A61G 7/1015
USPC ..... 5/123
See application file for complete search history.

(56) References Cited

U.S. PATENT DOCUMENTS 34,931 A * 4/1862 Timmins ..... A45F 3/22 5/121
202,814 A * 4/1878 Hanks ..... A45F 3/22 5/120
203,795 A * 5/1878 Sutton ..... A45F 3/22 5/122
312,988 A * 2/1885 Ewing ..... A47D 9/005 5/98.3
326,321 A * 9/1885 Nickerson ..... A45F 3/22 5/121
329,763 A * 11/1885 Nelmes ..... A45F 3/22 5/121
330,941 A * 11/1885 Travers ..... A45F 3/22 5/120
333,377 A * 12/1885 Adams ..... A45F 3/22 5/123
363,096 A * 5/1887 Travers ..... A45F 3/22 5/123
403,320 A * 5/1889 Beals ..... A45F 3/22 5/122
428,993 A * 5/1890 Wright ..... A45F 3/22 5/121
446,440 A * 2/1891 Franklin ..... A01K 69/06 43/105
466,013 A * 12/1891 Stiles ..... A45F 3/22 5/122

(Continued)

*Primary Examiner* — Nicholas F Polito
*Assistant Examiner* — Luke Hall
(74) *Attorney, Agent, or Firm* — Schwartz Law Firm, P.C.

(57) ABSTRACT

A convertible hammock assembly includes a flexible hammock defining a fabric bed having opposing ends and opposing sides, and suspension lines extending from the opposing ends of the fabric bed for hanging the flexible hammock between spaced apart structures. An elongated rigid spreader bar is located at one end of the fabric bed. A conversion cord selectively laterally tensions the fabric bed between opposite ends of the spreader bar, such that the flexible hammock is convertible between a generally inclined condition with increased lateral bed tension at the spreader bar, and a generally flat condition with reduced lateral bed tension at the spreader bar.

4 Claims, 17 Drawing Sheets

(56) References Cited

U.S. PATENT DOCUMENTS 492,852 A * 3/1893 Travers ..... A45F 3/22 5/123
495,366 A * 4/1893 Perry ..... A45F 3/22 5/121
631,747 A * 8/1899 Lloyd ..... A45F 3/22 5/122
635,261 A * 10/1899 Lassiter ..... A45F 3/24 5/130
717,119 A * 12/1902 Potter ..... A45F 3/22 5/122
803,091 A * 10/1905 Brayshaw ..... A45F 3/22 5/122
866,322 A * 9/1907 Barratt ..... A47D 9/005 5/98.3
955,281 A * 4/1910 Norwood ..... A45F 3/22 5/121
968,017 A * 8/1910 Wilson ..... A45F 3/22 5/121
1,136,986 A * 4/1915 Wagner ..... A45F 3/22 5/122
1,151,495 A * 8/1915 Menten ..... A45F 3/22 5/122
1,248,838 A * 12/1917 Foster ..... A45F 3/22 5/122
1,401,846 A * 12/1921 Wiles ..... A45F 3/22 5/121
1,480,591 A * 1/1924 Bakesef ..... A45F 3/24 5/128
1,543,814 A * 6/1925 Banning ..... A45F 3/22 5/122
1,557,055 A * 10/1925 Hoyle ..... A61G 7/1015 5/86.1
1,917,518 A * 7/1933 Goudie ..... A45F 3/22 5/120
2,096,423 A * 10/1937 Burr ..... A45F 3/22 5/122
2,220,330 A * 11/1940 Hilger ..... A45F 3/22 5/97
2,284,900 A * 6/1942 Henderson ..... A45F 3/22 5/122
2,321,966 A * 6/1943 Andersson ..... A45F 3/22 5/122
2,375,792 A * 5/1945 Kearny ..... A45F 3/22 5/121
2,467,890 A * 4/1949 Harvey ..... A47D 13/025 5/122
3,924,281 A * 12/1975 Gibbs ..... A61G 7/1055 5/88.1
4,001,902 A * 1/1977 Hall ..... A45F 3/22 5/121
4,021,868 A * 5/1977 Fueslein ..... A45F 3/22 5/123
4,057,859 A * 11/1977 Setterholm ..... E04H 15/04 5/121
4,221,429 A * 9/1980 Wade ..... A47C 7/66 297/277
4,262,375 A * 4/1981 Lilienthal ..... A61G 7/1015 5/695
4,270,234 A * 6/1981 James ..... A61G 7/1015 5/88.1
4,320,542 A * 3/1982 Cohen ..... E04H 15/04 5/121
4,347,914 A * 9/1982 Gary ..... A45F 3/26 182/142
4,686,720 A * 8/1987 Newell ..... E04H 15/04 5/121
4,759,425 A * 7/1988 Turner ..... A01M 31/02 182/187
4,807,314 A * 2/1989 Fry ..... A45F 3/22 5/118
4,996,732 A * 3/1991 Chang ..... A47D 9/02 5/101
5,655,235 A * 8/1997 DeAth ..... A45F 3/24 5/121
5,913,772 A * 6/1999 Clark ..... E04H 15/04 5/121
D414,957 S * 10/1999 Rajacich ..... D21/834
6,353,946 B1 * 3/2002 Steiner ..... A45B 3/00 5/120
6,701,549 B1 * 3/2004 Eriksen ..... A45F 3/22 5/120
7,020,915 B1 * 4/2006 Helsdon ..... A45F 3/22 5/121
7,788,745 B1 * 9/2010 Beaton ..... A45F 3/22 5/120
8,075,464 B2 * 12/2011 Hayes ..... A63B 21/4037 482/142
8,356,370 B1 * 1/2013 Clark ..... A45F 3/24 5/123
8,365,749 B2 * 2/2013 Overbaugh ..... E04H 15/04 135/90
8,806,676 B2 * 8/2014 Reeb ..... A45F 3/24 5/120
9,226,564 B1 * 1/2016 Cross ..... B63B 32/80
9,314,090 B1 * 4/2016 Manning ..... E04H 15/04
2003/0028962 A1 * 2/2003 Batchelder ..... A45F 3/22 5/120
2005/0144719 A1 * 7/2005 Branch ..... A45F 3/22 5/122
2005/0188460 A1 * 9/2005 O'Brien ..... A45F 3/22 5/121
2006/0151244 A1 * 7/2006 McInnes ..... B66C 23/52 182/187
2009/0058117 A1 * 3/2009 Di Martino ..... B66C 1/22 294/81.5
2011/0010849 A1 * 1/2011 Lemmens ..... A45F 3/22 5/123
2012/0060278 A1 * 3/2012 McCurdy ..... D07B 1/02 5/120
2013/0049432 A1 * 2/2013 Deets, III ..... A47C 15/004 297/452.1
2013/0239332 A1 * 9/2013 Pringle-Parker ..... A61G 1/013 5/628
2014/0158174 A1 * 6/2014 Rhett, Jr. ..... E04H 15/34 135/121
2014/0304911 A1 * 10/2014 Kramer ..... A45F 3/22 5/121
2014/0345049 A1 * 11/2014 Gash ..... A45F 3/22 5/121
2015/0089776 A1 * 4/2015 Meillan ..... F16G 11/14 24/318
2016/0242539 A1 * 8/2016 Paya ..... A45F 3/22
2016/0242974 A1 * 8/2016 Rugfelt ..... A61G 1/01
2016/0338476 A1 * 11/2016 Haug ..... A45F 3/22
2016/0338477 A1 * 11/2016 Browning ..... A47G 9/08
2017/0224092 A1 * 8/2017 Smith, Jr. ..... A45F 3/22
2017/0290408 A1 * 10/2017 Meillan ..... A45F 3/22
2017/0332769 A1 * 11/2017 Stinnett ..... A45F 3/52
2018/0002943 A1 * 1/2018 Jensen ..... A47G 33/12
2018/0049540 A1 * 2/2018 Stapf ..... A45F 3/24
2018/0055200 A1 * 3/2018 Fries ..... A45F 3/24
2018/0070707 A1 * 3/2018 Ressler ..... A45F 3/22
2018/0303229 A1 * 10/2018 Lystrup ..... A45F 3/22
2019/0231623 A1 * 8/2019 Yeckel ..... A61G 7/1061
2019/0254410 A1 * 8/2019 DuVall ..... A41D 3/08
2019/0328115 A1 * 10/2019 Grisar ..... A45F 3/26

* cited by examiner

CONVERTIBLE HAMMOCK ASSEMBLY, AND METHOD FOR CONVERTING A FLEXIBLE HAMMOCK TO AN INCLINED FORM

TECHNICAL FIELD AND BACKGROUND OF THE DISCLOSURE

The present disclosure relates broadly and generally to a convertible hammock assembly, and method for converting a flexible hammock to an inclined form.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a convertible hammock assembly. The hammock assembly incorporates a flexible hammock comprising a fabric bed (or hammock body) having opposing ends and opposing sides, and suspension lines extending from the opposing ends of the fabric bed for hanging the flexible hammock between spaced apart structures. An elongated rigid spreader bar is located at one end of the fabric bed. Means are provided for selectively laterally tensioning the fabric bed between opposite ends of the spreader bar, such that the flexible hammock is convertible between a generally inclined condition with increased lateral bed tension at the spreader bar, and a generally flat condition with reduced lateral bed tension at the spreader bar.

According to another exemplary embodiment, the fabric bed comprises a fabric end panel having a top edge adjacent to the spreader bar and a bottom edge having a length greater than the length of the top edge.

According to another exemplary embodiment, the means for selectively laterally tensioning the fabric bed comprises a flexible conversion cord secured to the fabric end panel. The conversion cord has first and second free ends extending through respective caps located at opposite ends of the spreader bar. Pulling the free ends of the conversion cord outwardly from the fabric bed draws the bottom edge of the fabric end panel upward towards the top edge of the fabric end panel, thereby increasing the lateral bed tension at the spreader bar.

According to another exemplary embodiment, the conversion cord is slidably received through a hem formed at the bottom edge of the fabric end panel. The hem may be formed entirely along the bottom edge of the fabric end panel or only partially along the bottom edge of the fabric end panel.

According to another exemplary embodiment, fasteners are located at respective free ends of the conversion cord, and are adapted for being releasably attached to the hammock suspension lines.

According to another exemplary embodiment, the fasteners of the conversion cord comprise toggles. Alternatively, the fasteners may comprise karabiners or the like.

According to another exemplary embodiment, the hammock suspension lines comprise respective loops adapted for receiving the toggles of the conversion cord.

According to another exemplary embodiment, first and second release handles are attached to the conversion cord (or fabric bed) and spaced apart from respective toggles. The release handles allow the conversion cord to be manually pulled inwardly towards the fabric bed, thereby reducing the lateral bed tension at the spreader bar such that the flexible hammock converts back to its generally flat condition. Alternatively, the conversion cord could be slidably moved without the use of release handles.

According to another exemplary embodiment, a first (cord) guide is fixed to the hammock suspension line adjacent the spreader bar, and defines a guide opening slidably receiving the conversion cord.

According to another exemplary embodiment, a second (line) guide is affixed to the conversion cord adjacent the toggle, and defines a guide opening slidably receiving the hammock suspension line.

According to another exemplary embodiment, the fabric bed is constructed in whole or in part of a ripstop fabric.

According to another exemplary embodiment, a second elongated rigid spreader bar is located at the opposite end of the fabric bed. The opposite end of the fabric bed may also include means for selectively laterally tensioning the fabric bed, as described herein.

In another exemplary embodiment, a convertible hammock assembly of the present disclosure comprises a flexible hammock, an elongated rigid spreader bar, and a flexible conversion cord. The flexible hammock comprises a fabric bed having opposing ends and opposing sides, and suspension lines extending from the opposing ends of the fabric bed for hanging the flexible hammock between spaced apart structures. The spreader bar is located at one end of the fabric bed. The conversion cord is secured to the fabric bed, and has first and second free ends extending through respective caps located at opposite ends of the spreader bar, whereby pulling the free ends of the conversion cord outwardly from the fabric bed converts the flexible hammock from a generally flat condition with reduced lateral bed tension at the spreader bar to a generally inclined condition with increased lateral bed tension at the spreader bar.

The term "hammock" refers broadly herein to any hanging bed, seat, couch, or other suspended or partially suspended support or sling made of any rigid and/or flexible material including nylon, canvas, netted cord or rope, rigid framing or the like. Exemplary hammocks may have straps, cords, cables, lines, ropes, or other extensions attached to supports at one or both ends. The hammock bed or body may be any size, shape or pattern. As used herein, the terms "cord", "line", and "strap" refer broadly to any flexible elongated structure including rope, cable, webbing, and the like.

BRIEF DESCRIPTION OF THE DRAWINGS

Exemplary embodiments of the present disclosure will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
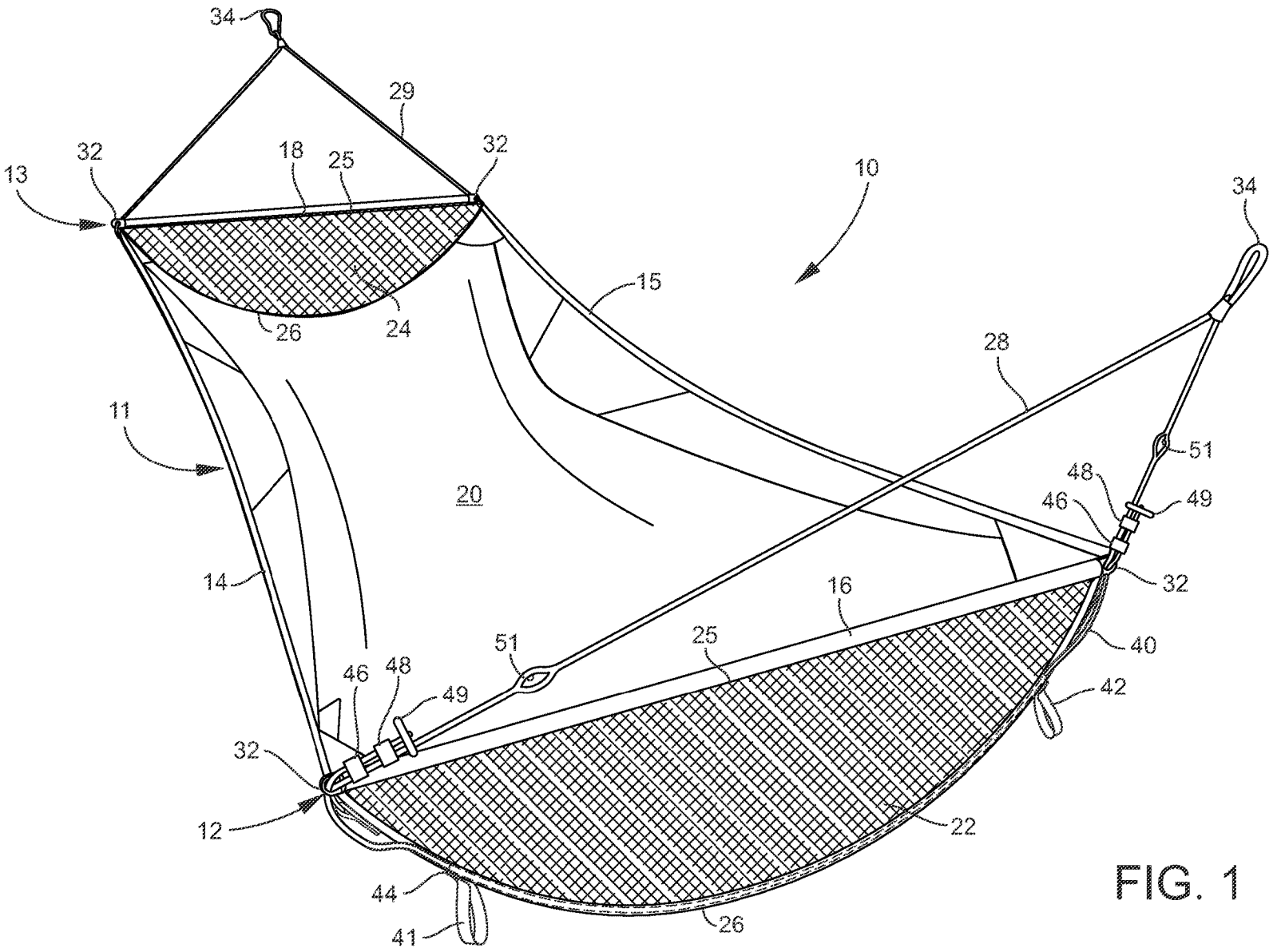
FIG. 1 is a perspective view of an exemplary convertible hammock assembly in a generally flat-lying form.
Figure 2:
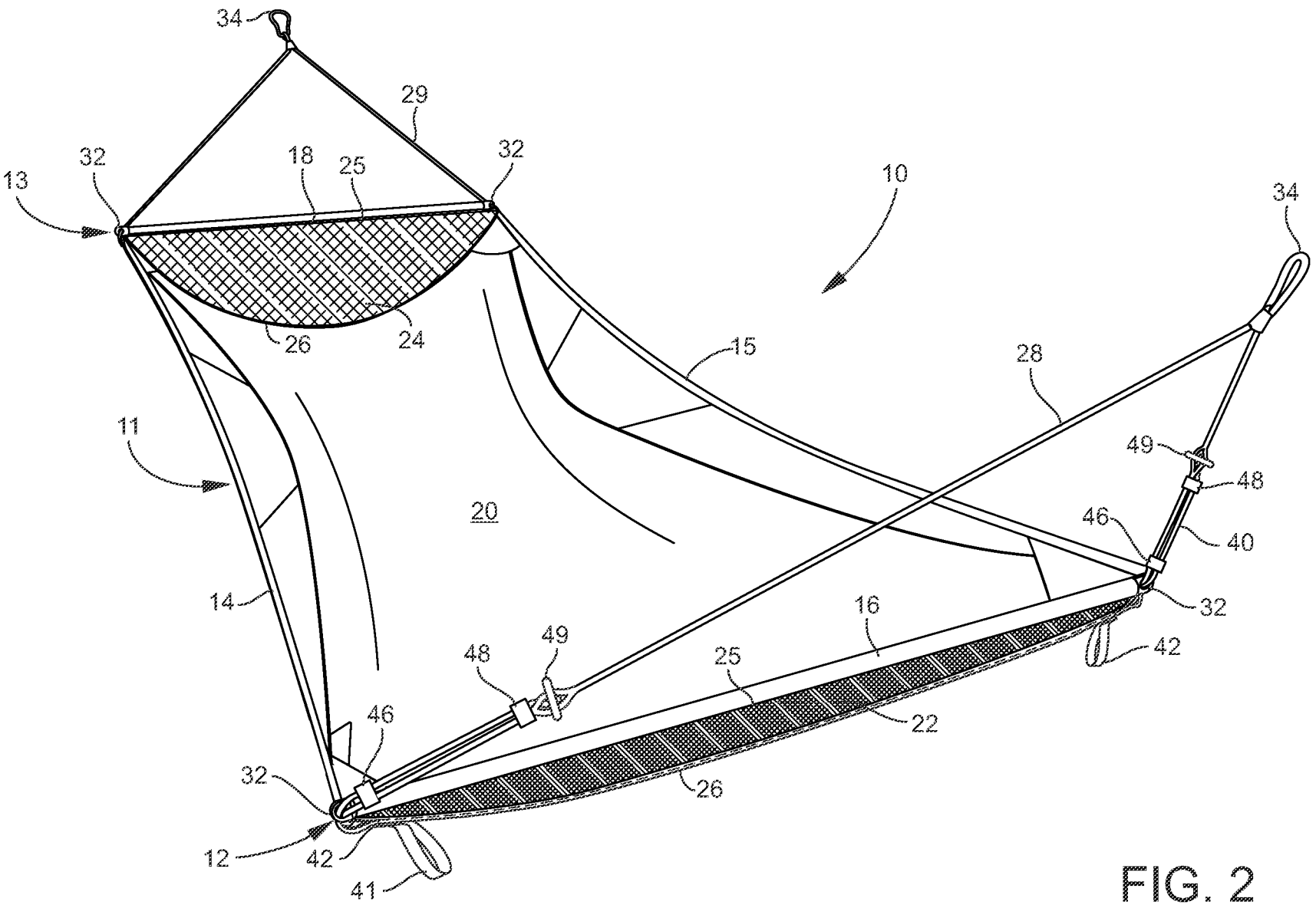
FIG. 2 is a further perspective view of the exemplary hammock assembly converted to a generally inclined form.

Referring now specifically to the drawings, a convertible hammock assembly according to one exemplary embodiment of the present disclosure is illustrated in FIGS. 1 and 2, and shown generally at broad reference numeral 10. The exemplary assembly 10 comprises a flexible fabric hammock 11 having opposing head and foot ends 12, 13, opposing longitudinal sides 14, 15, and a pair of elongated rigid spreader bars 16, 18. The ends 12, 13 and sides 14, 15 of the hammock 11 define a fabric bed 20 for supporting one or more users. The spreader bars 16, 18 are located at the head and foot ends 12, 13 of the hammock 11, and function to laterally open or spread-apart the longitudinal sides 14, 15 of the fabric bed 20. In one exemplary embodiment, fabric end panels 22, 24 are secured to respective spreader bars 16, 18 (either directly or indirectly), and attached to the fabric bed 20 of the hammock 11 at its head and foot ends 12, 13. Each end panel 22, 24 has a top edge 25 residing directly adjacent the spreader bar 16, 18, and a normally-relaxed (loosely tensioned) bottom edge 26 sewn directly to the fabric bed 20 at a reinforced seam—the length of the bottom edge 26 being longer than a length of the top edge 25. The hammock bed 20 and end panels 22, 24 may be constructed (in whole or in part) of any suitable fabric, such as any fiber-based material. For example, the hammock 11 may comprise a lightweight durable and breathable, quick drying, 70-denier, nylon ripstop fabric. The exemplary hammock bed 20 may be single or double nest, and may have a load capacity of 400 pounds or more. The exemplary end panels 22, 24 may be constructed of a more open-mesh nylon fabric or "netting". The exemplary spreader bars 16, 18 may be constructed of a lightweight aluminum or other metal, plastic, fiberglass, wood, composite material, or the like.

Flexible suspension lines 28, 29 are attached to looped webbing 31 sewn to the fabric bed 20 at respective head and foot ends 12, 13 of the hammock 11. The suspension lines 28, 29 extend outwardly from the hammock 11 through ringed "O-shaped" (or open "C-shaped") end caps 32 of the spreader bars 16, 18. Each line 28, 29 comprises a centrally-located metal karabiner 34 or other such fastener. The metal karabiners 34 serve to releasably secure the assembly 10 to cooperating hammock straps, flexible cables, eye bolts or other hardware (not shown). In one embodiment, a pair of multi-looped hammock straps are used to hang the assembly 10 from elevated suspension points between spaced apart structures, such as trees, vertical frames, posts, or the like—or any combination thereof. One exemplary hammock strap having a multi-looped construction is disclosed in Applicant's prior issued U.S. Pat. Nos. 9,003,579; 9,320,343; and 9,622,566. The complete disclosures of these prior patents are incorporated herein by reference. In one embodiment, the suspension lines 28, 29 are constructed of UHMWPE rope, such as that sold under the brand name Dyneema®.

Figure 11:
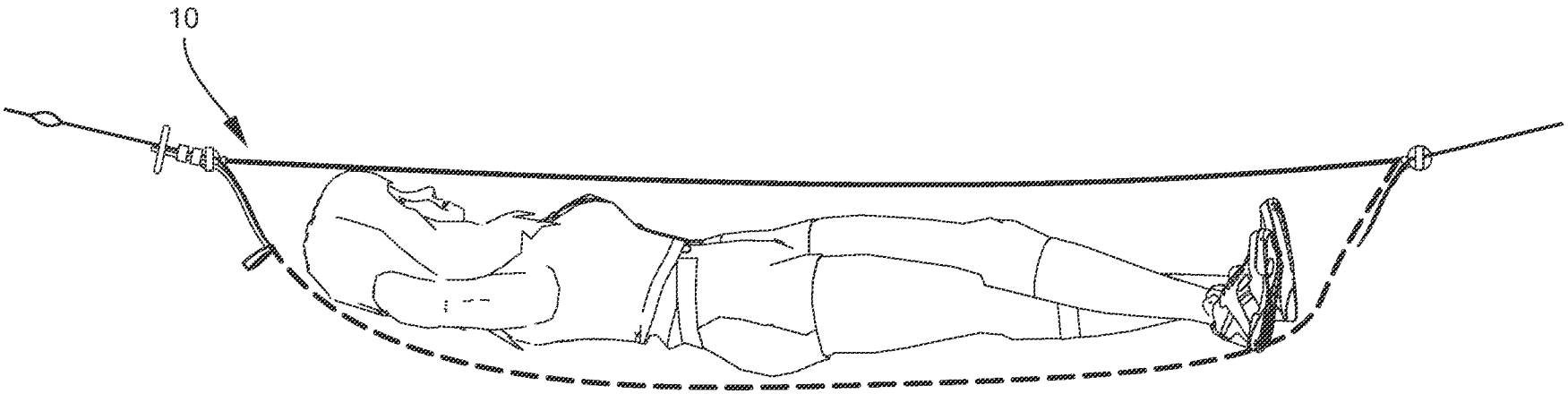
FIG. 11 is a schematic view demonstrating use of the exemplary hammock assembly in its normal flat-lying form.
Figure 12:
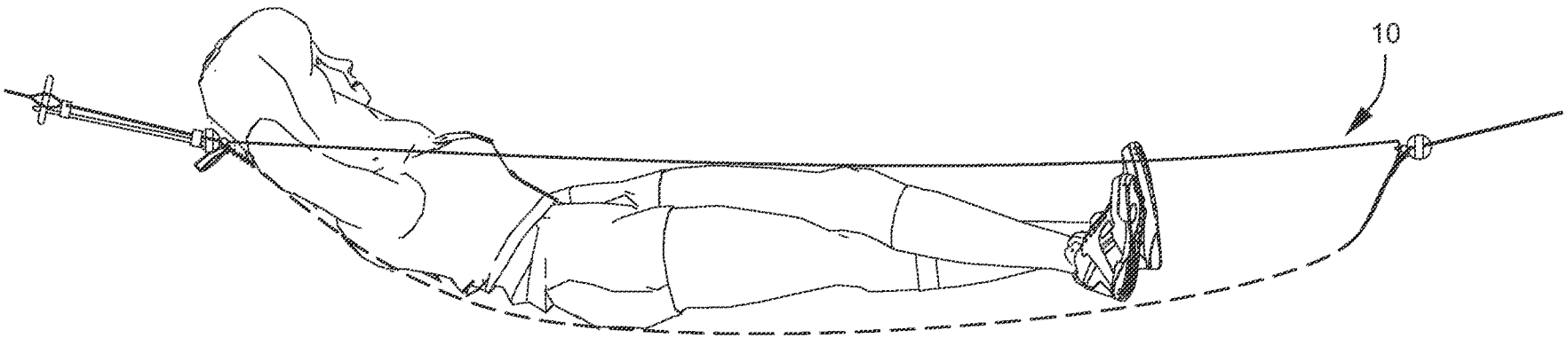
FIG. 12 is a further schematic view demonstrating use of the exemplary hammock assembly in its converted inclined form.

As discussed further below, the exemplary hammock assembly 10 is designed to readily convert between a generally flat-lying bed form, as shown in FIGS. 1 and 11, and a generally inclined bed form shown in FIGS. 2 and 12. In the inclined form, lateral tension in the fabric bed 20 is increased between opposite ends of the spreader bar 16 at the head end 12 of the hammock 11. In the embodiment of FIGS. 1 and 2, a manual conversion cord 40 and release handles 41, 42 are used to selectively adjust the fabric tension at the head end 12 of the hammock bed 20. Diagrammatic FIGS. 3-8 demonstrate operation of the conversion cord 40 and release handles 41, 42 in the exemplary hammock assembly 10. Alternative exemplary means for converting the hammock assembly 10 are illustrated in FIGS. 13-18, and discuss further below.

Referring to FIGS. 3-8, 9, 9A, 10, and 10A, in one embodiment the conversion cord 40 comprises a single flexible line extending through an open hem 44 formed along the bottom edge 26 (or seam) of the end panel 22 at the head end 12 of hammock bed 20. Alternatively, in an embodiment of the hammock assembly 10 without one or both end panels 22, 24, the conversion cord 40 may be secured directly or indirectly to the fabric bed 20 at or proximate an edge seam. The release handles 41, 42 are sewn directly to the conversion cord 40 and bottom hem 44 of end panel 22 at spaced-apart points along the fabric seam where the conversion cord 40 extends from the bottom hem 44 upwardly towards the ringed end caps 32 of spreader bar 16. Free ends of the conversion cord 40 pass through the ringed end caps 32 of spreader bar 16, through pairs of cord and line guides 46, 48, and terminate at rigid toggles 49. The cord guide 46 is affixed to the suspension line 28 adjacent the end cap 32 of spreader bar 16, and defines a guide opening 46A which slidably receives the conversion cord 40. The line guide 48 is affixed to the conversion cord 40 adjacent the toggle 49, and defines a guide opening 48A which slidably receives the suspension line 28. The suspension line 28 at the head end 12 of the hammock 11 has strategically spaced, integrally-formed loops 51 designed to receive respective toggles 49 of the conversion cord 40.

Figure 9:
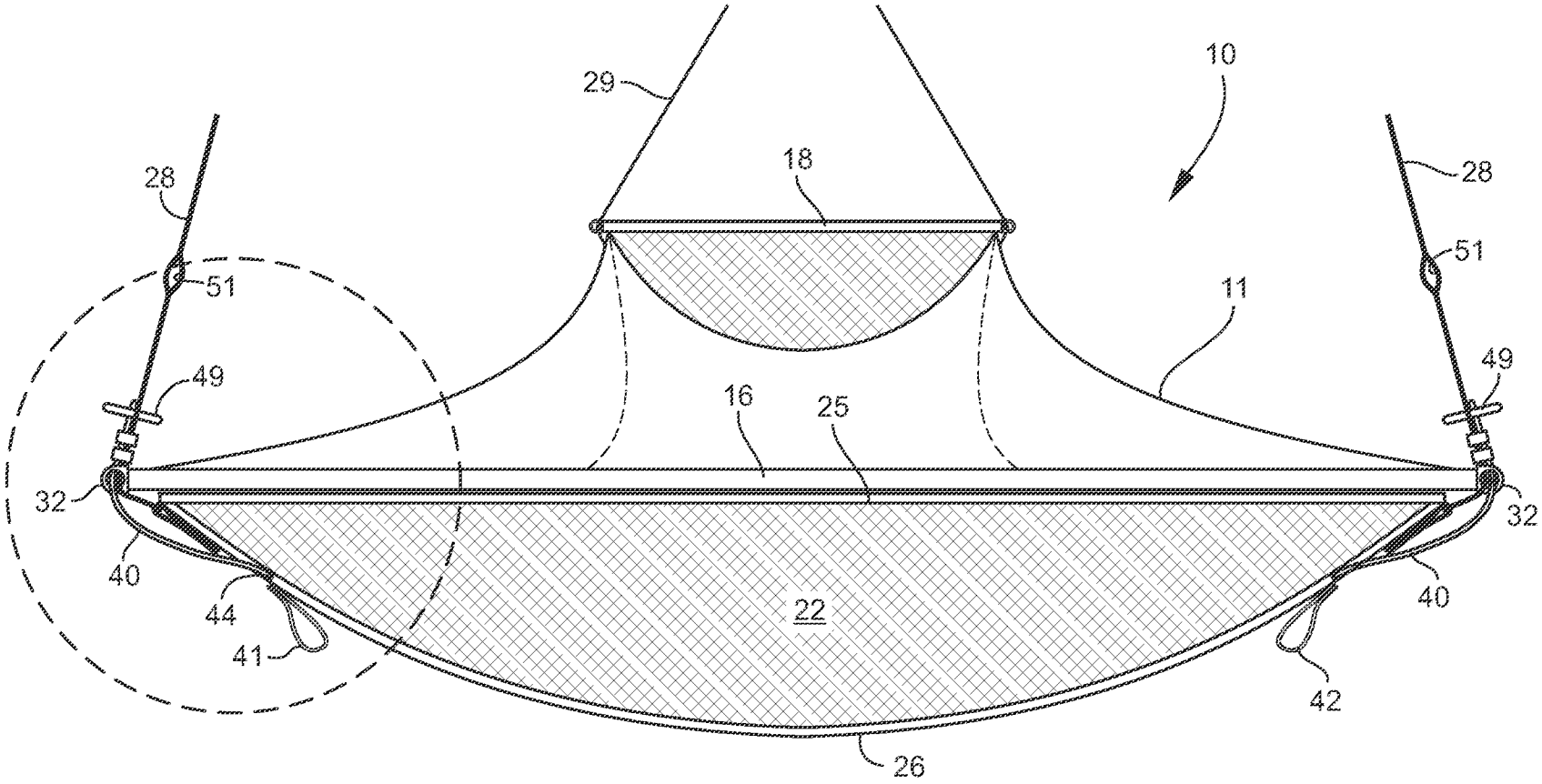
FIGS. 9 and 9A are further views of the exemplary hammock assembly in its normal flat-lying form.
Figure 9A:
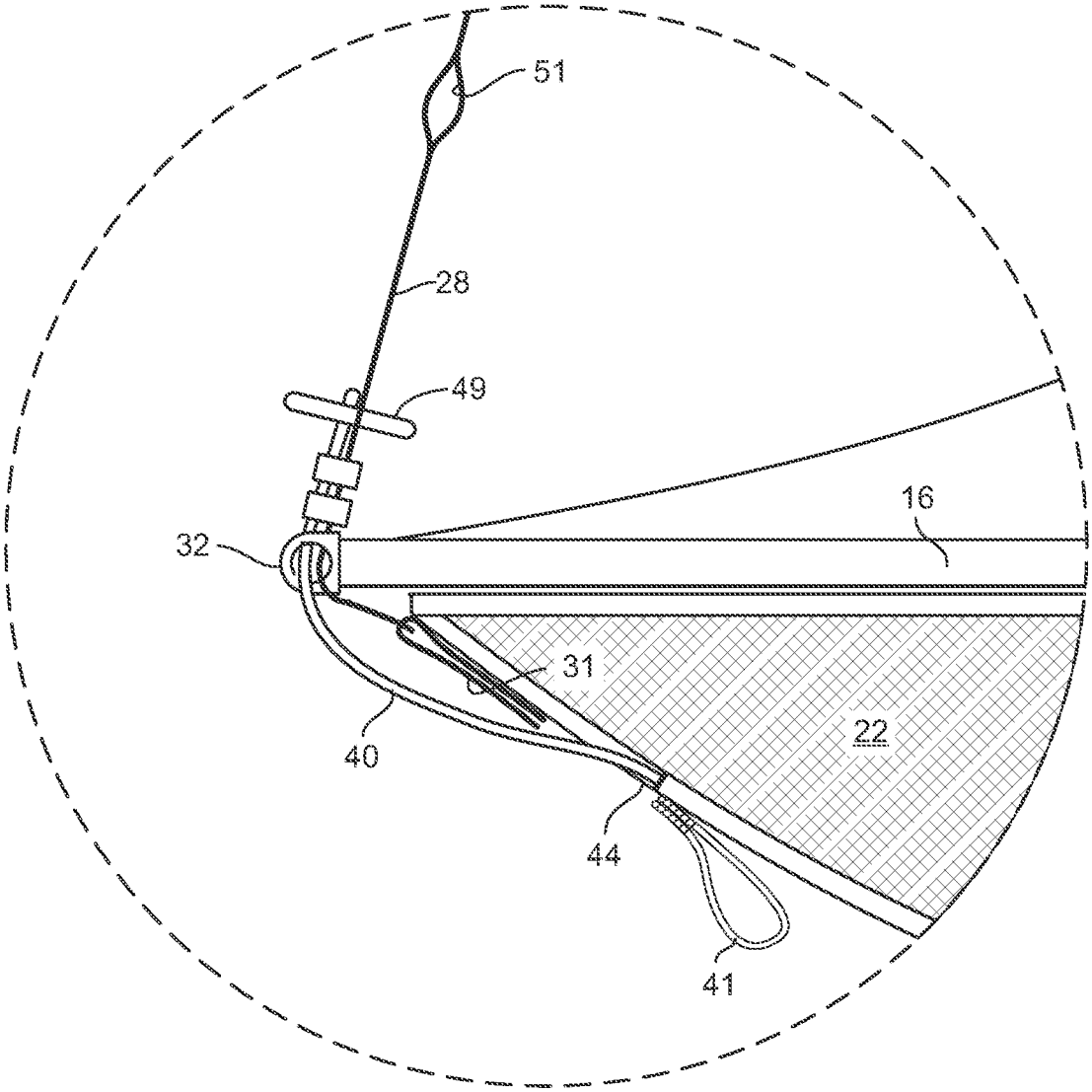
Figure 10:
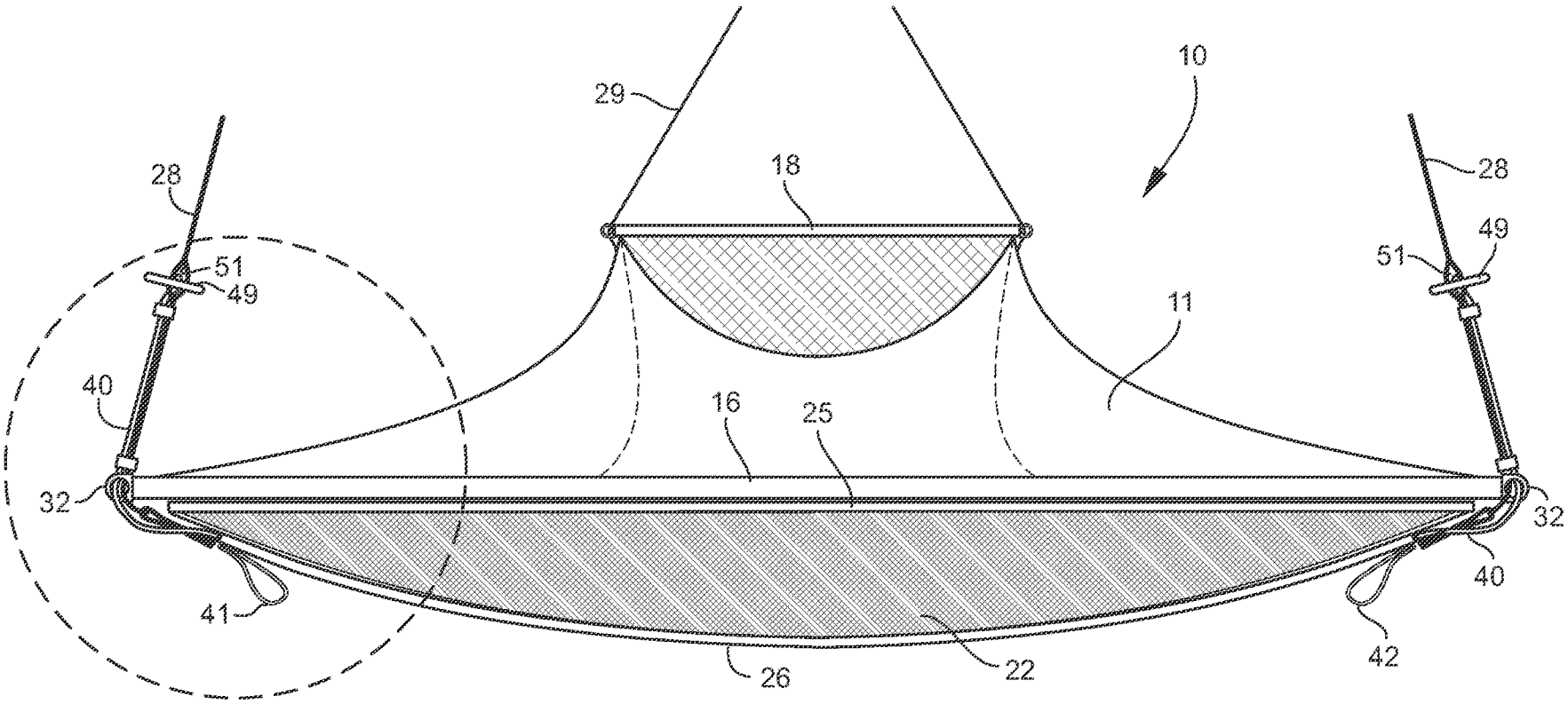
FIGS. 10 and 10A are views of the exemplary hammock assembly in its converted inclined form.
Figure 10A:
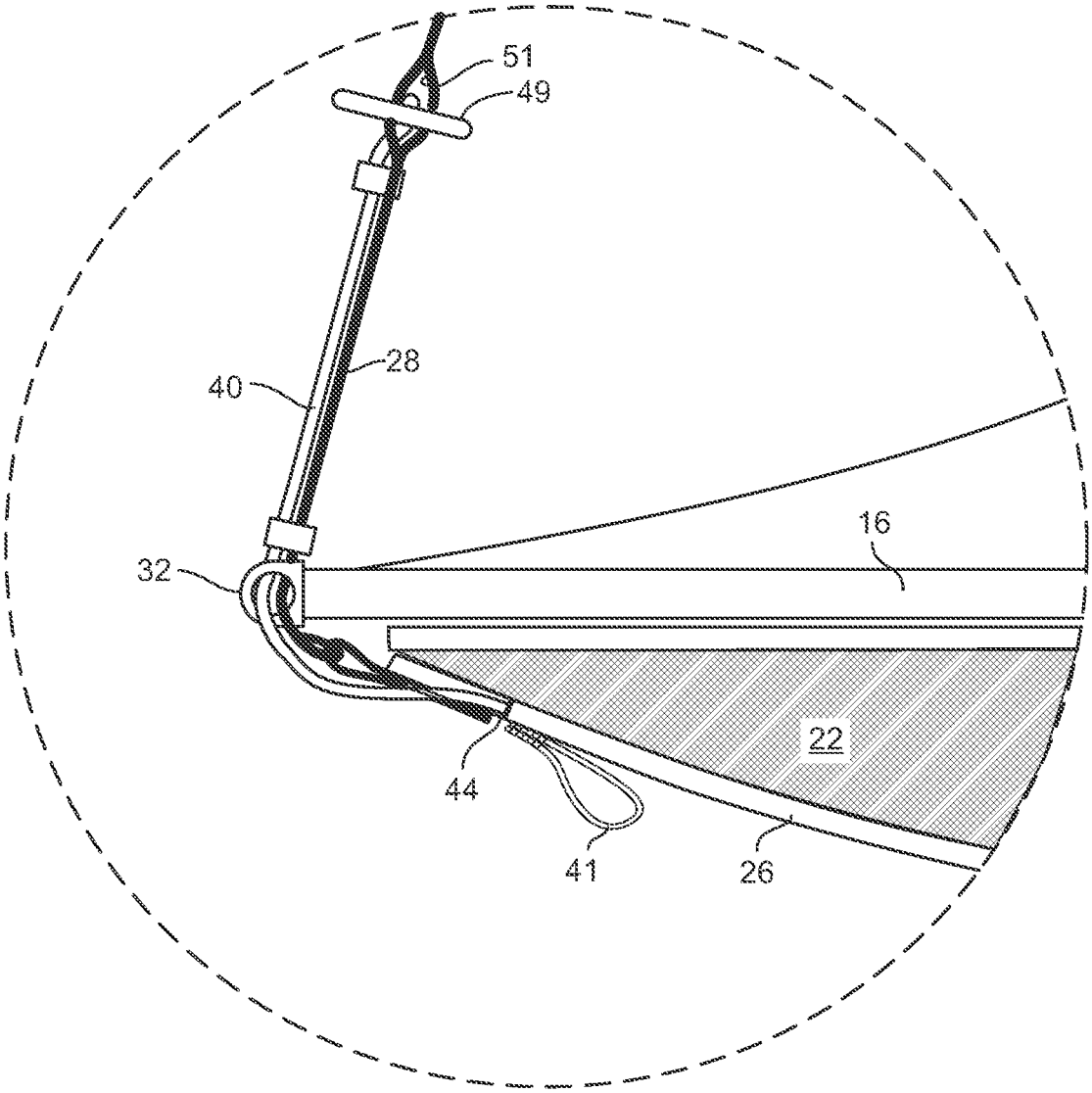

FIGS. 9 and 9A show the hammock assembly 10 in its generally flat-lying form with the toggles 49 located adjacent respective end caps 32 of the spreader bar 16. FIGS. 10 and 10A show the hammock assembly 10 converted to its generally inclined form with the toggles 49 inserted into respective loops 51 of the suspension line 28. The process for converting exemplary hammock assembly 10 is described further below.

Figure 3:
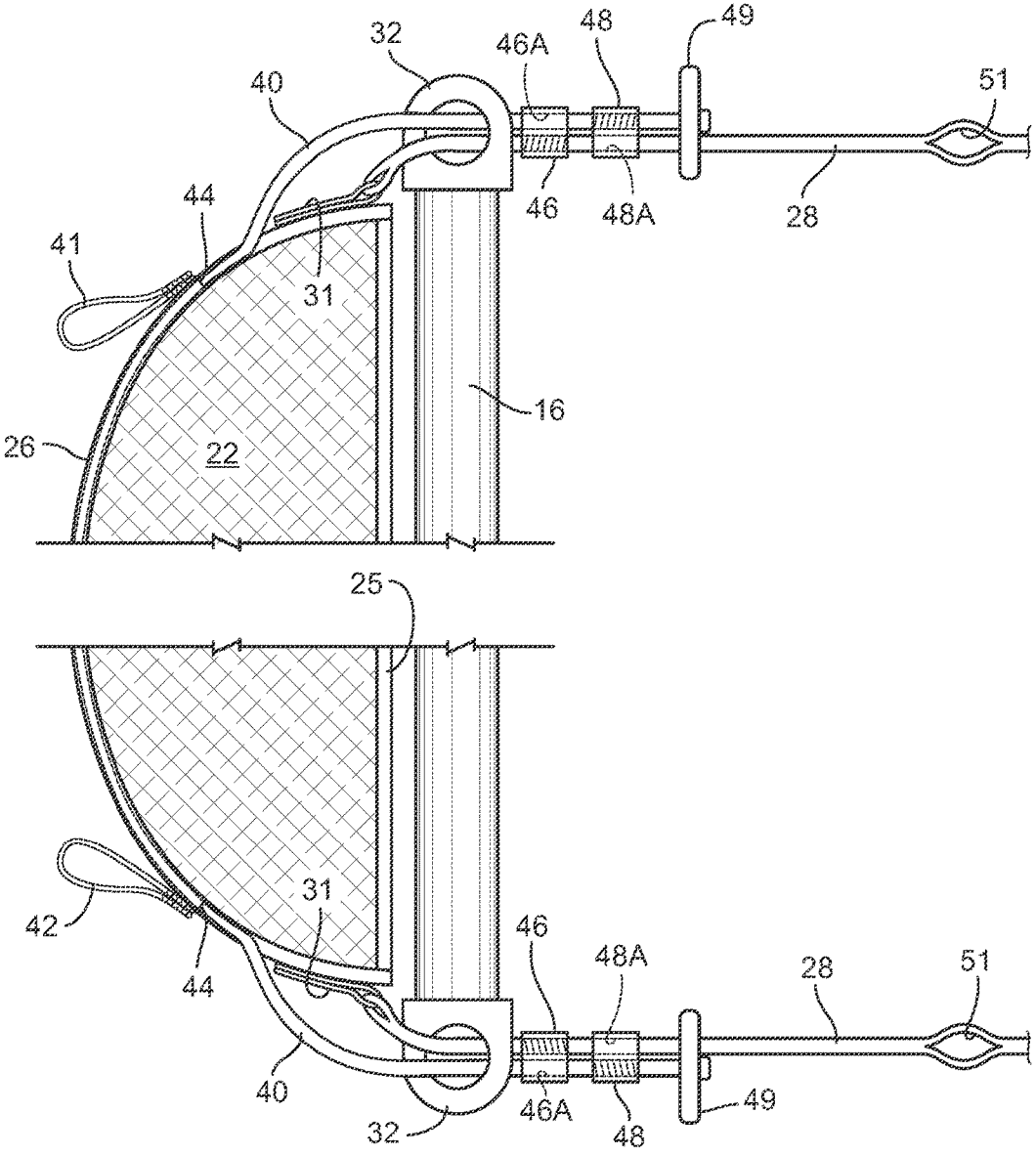
FIGS. 3-8 are diagrammatic views demonstrating sequential transition of the hammock assembly between its generally flat-lying and inclined forms.
Figure 4:
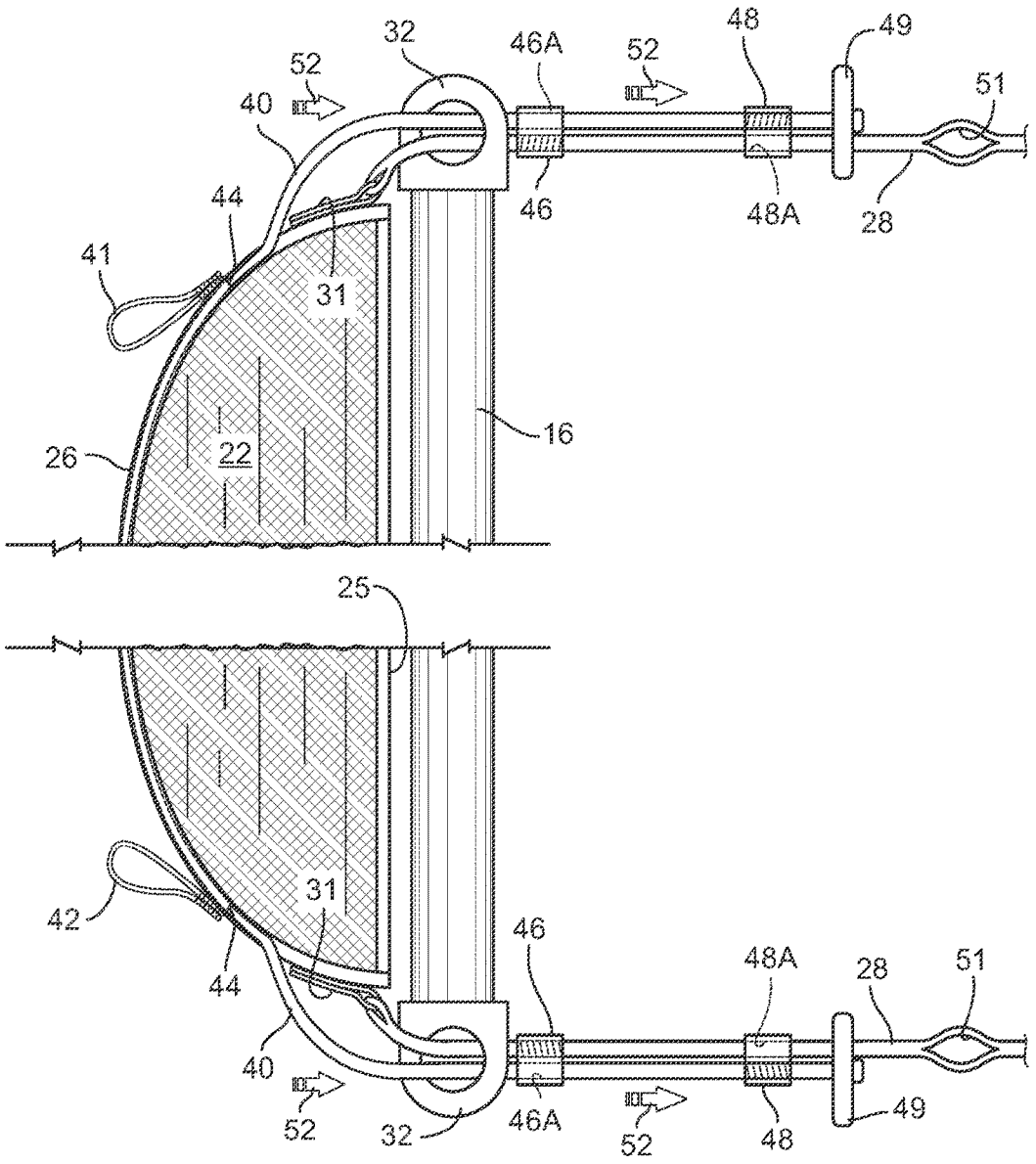
Figure 5:
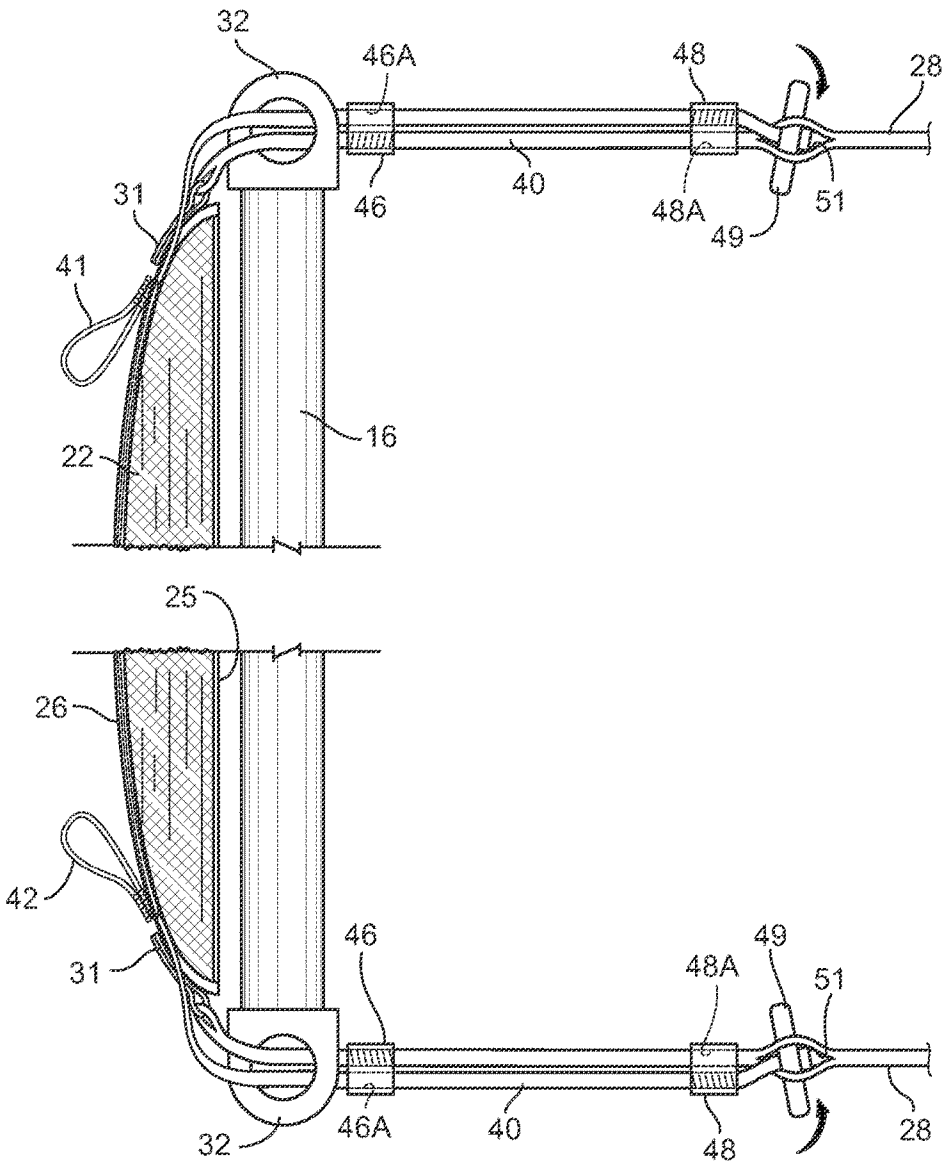

FIG. 3 represents components of the hammock assembly 10 shown in the generally flat-lying bed form. To convert the hammock assembly 10 to its inclined form, the user grasps and pulls each toggle 49 of the conversion cord 40 outwardly from the hammock 11 towards each loop 51 of the suspension line 28, as indicated by direction arrows 52 in FIG. 4. The toggles 49 may be pulled one at a time, or simultaneously with the help of a second user. As the toggles 49 are pulled, the conversion cord 40 begins to lift and tension the bottom edge 26 of the end panel 22, thereby increasing fabric tension at the head end spreader bar 16 of hammock 11. The increased fabric tension is sufficient to support the upper torso of the user in a generally inclined "alert" position shown in FIG. 11. In this position, the user can enjoy a more complete view of his or her surroundings outside of the hammock assembly 10. When the bed conversion is completed, the toggles 49 are inserted into the loops 51 of the suspension line 28 (as demonstrated in FIG. 5) to retain the hammock assembly 10 in its generally inclined form.

Figure 6:
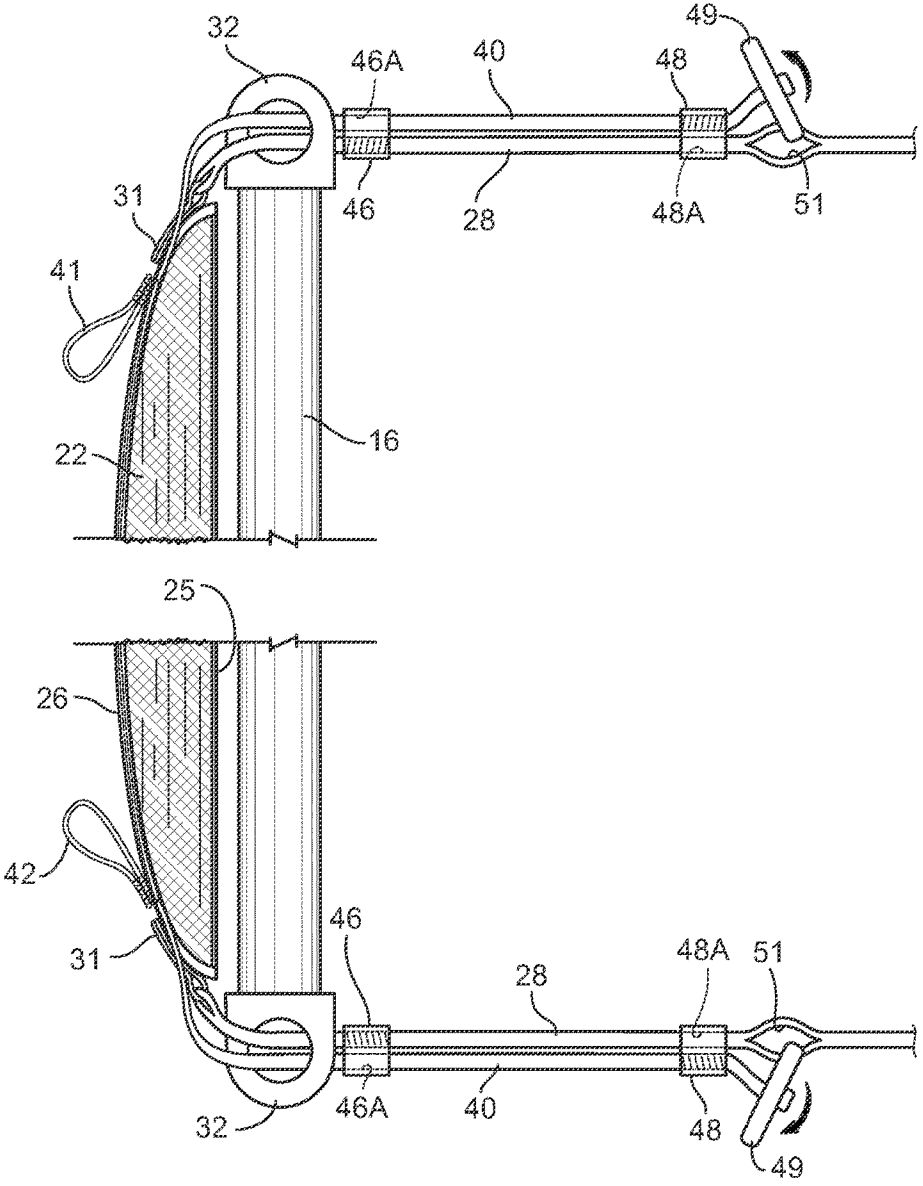
Figure 7:
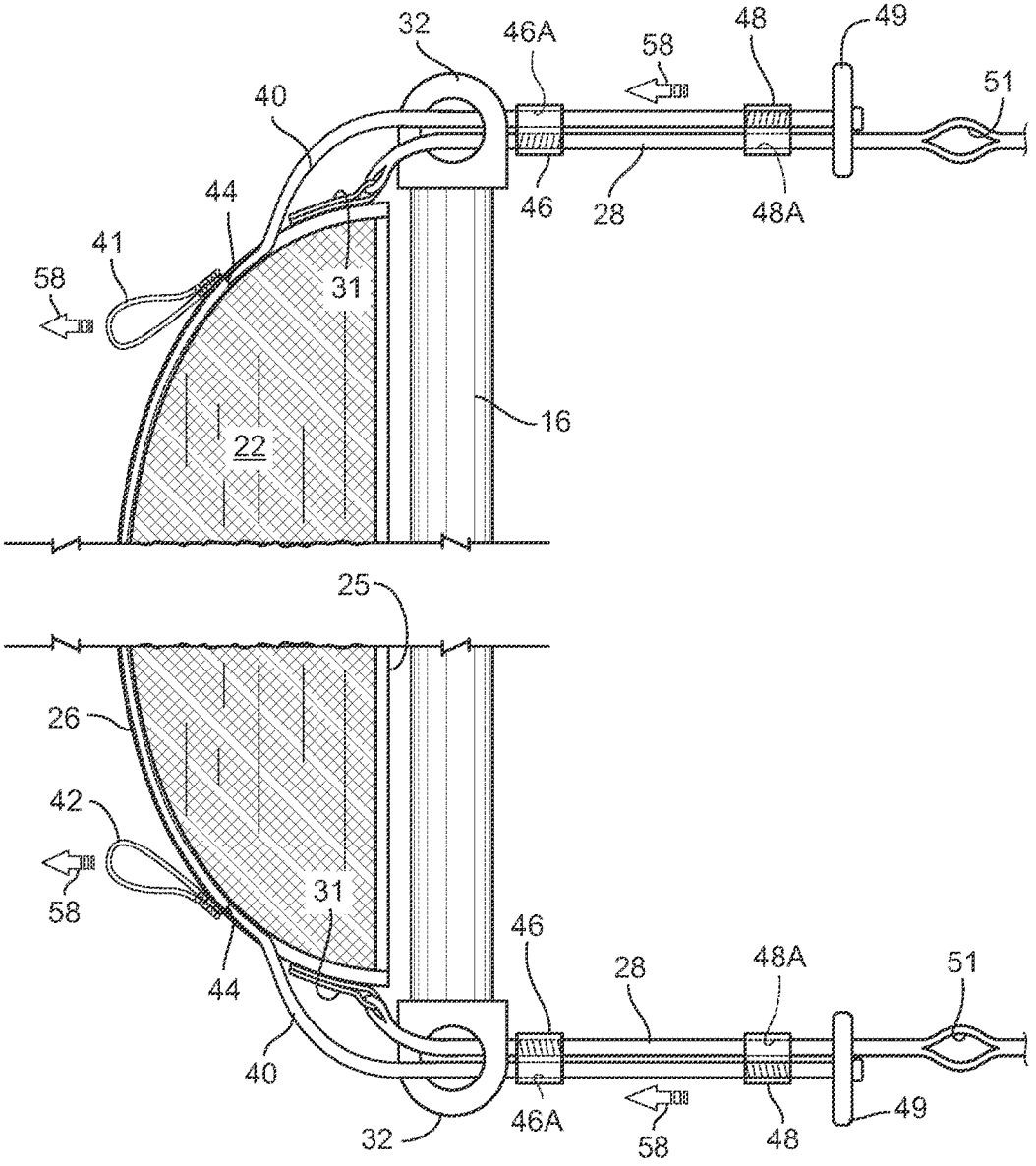
Figure 8:
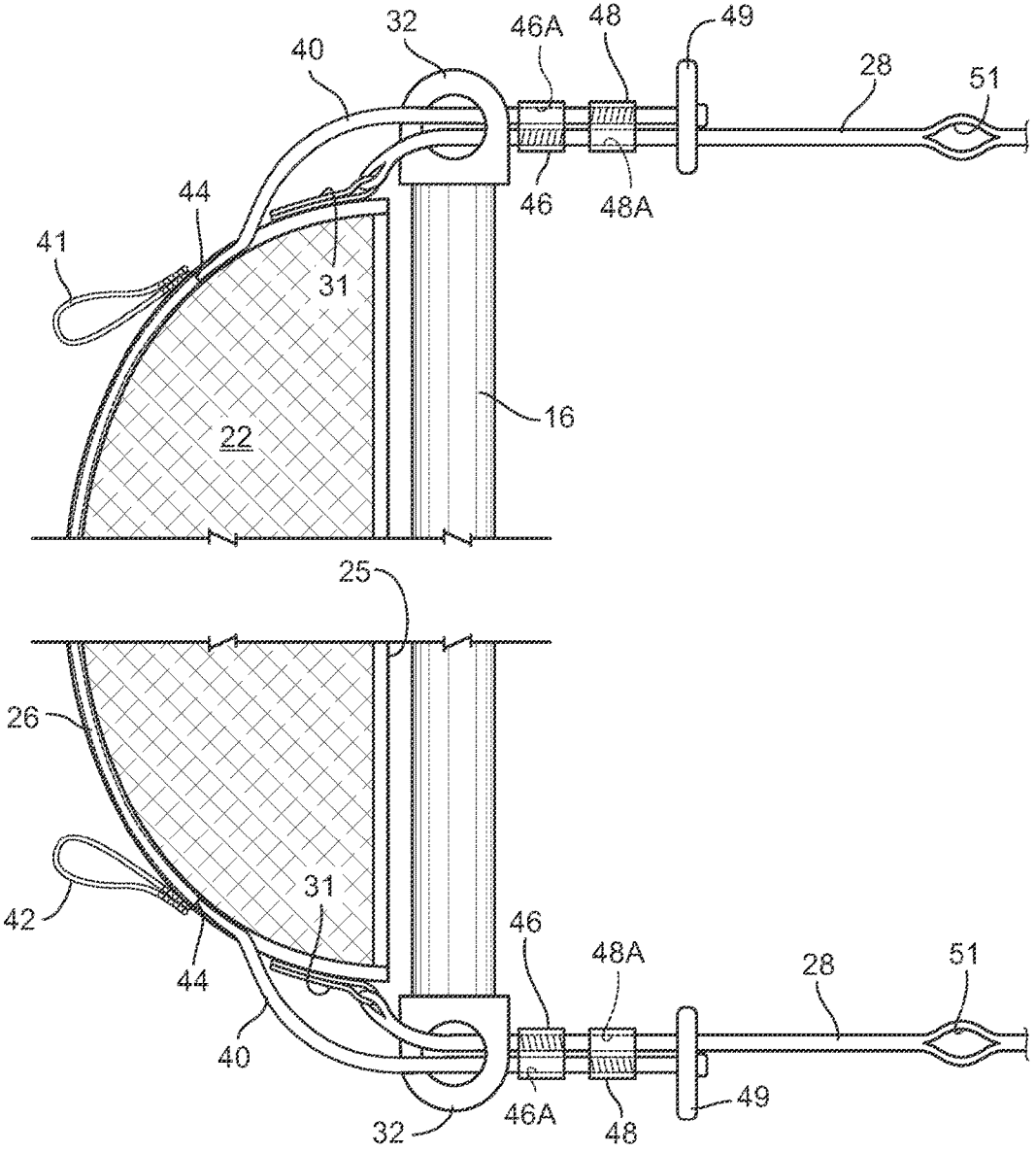

When the user desires to return the hammock assembly 10 to its generally flay-lying form, the toggles 49 are first removed from the loops 51 of the suspension line 28 as demonstrated in FIG. 6. Each release handle 41, 42 is then grasped and pulled downwardly, as indicated by arrows 58 in FIG. 7, thereby releasing the fabric tension at the head end spreader bar 16 of hammock 11. This returns the end panel 22 to its loosely tensioned condition, such that a user lying in the hammock 11 is supported as shown in FIG. 12 in a relatively flat "privacy" position substantially enveloped by the sides 14, 15 of the fabric bed 20.

Figure 13:
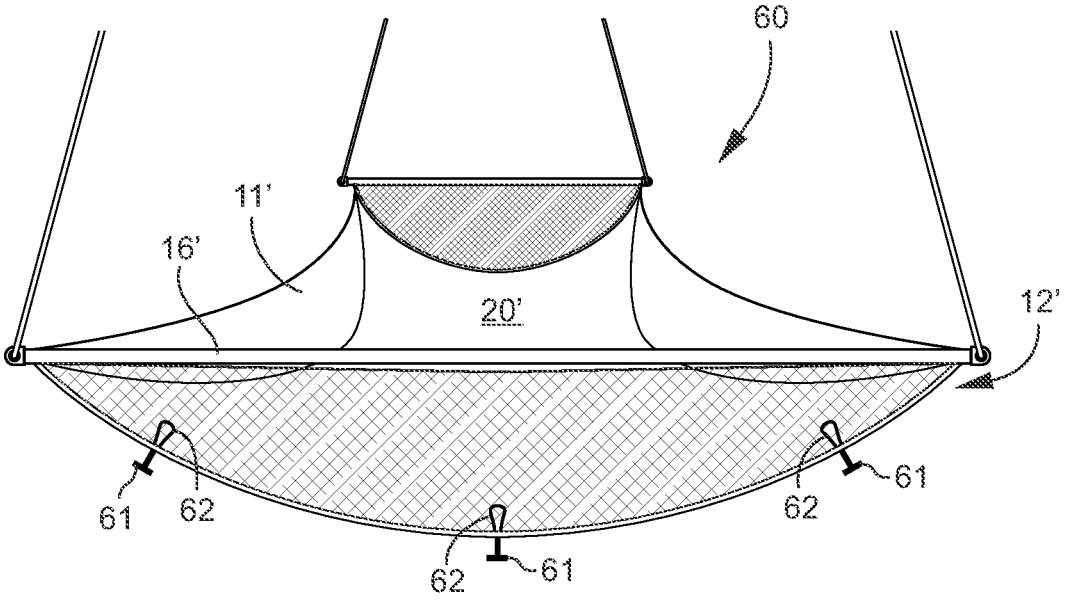
FIGS. 13 and 14 illustrate a second exemplary embodiment of the present convertible hammock assembly.
Figure 14:
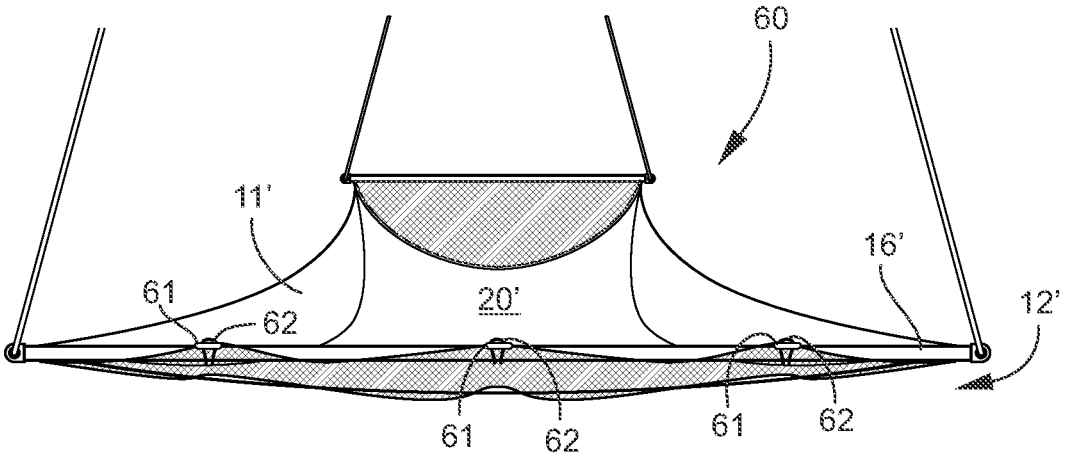

A further embodiment of the exemplary hammock assembly 60 is disclosed in FIGS. 13 and 14. Like elements described above with reference to the hammock assembly 10 are indicated below and in the drawings in prime notation (').

In this alternative embodiment, the means for selectively laterally tensioning the fabric bed 20' at the head end spreader bar 16' includes a plurality of cooperating toggles 61 and loops 62 spaced apart in pairs along the bottom edge 26' of the end panel 22'. With the toggles 61 detached from their corresponding loops 62, as shown in FIG. 13, the hammock assembly 60 is loosely tensioned at the head end 12' of the fabric bed 20', such that the hammock 11' resides in a normal generally flat-lying form. By attaching the toggles 61 and loops 62 around the head end spreader bar 16', as shown in FIG. 14, the bed tension at the spreader bar 16' increases thereby converting the hammock assembly 60 from its generally flat-lying form to a generally inclined form.

Figure 15:
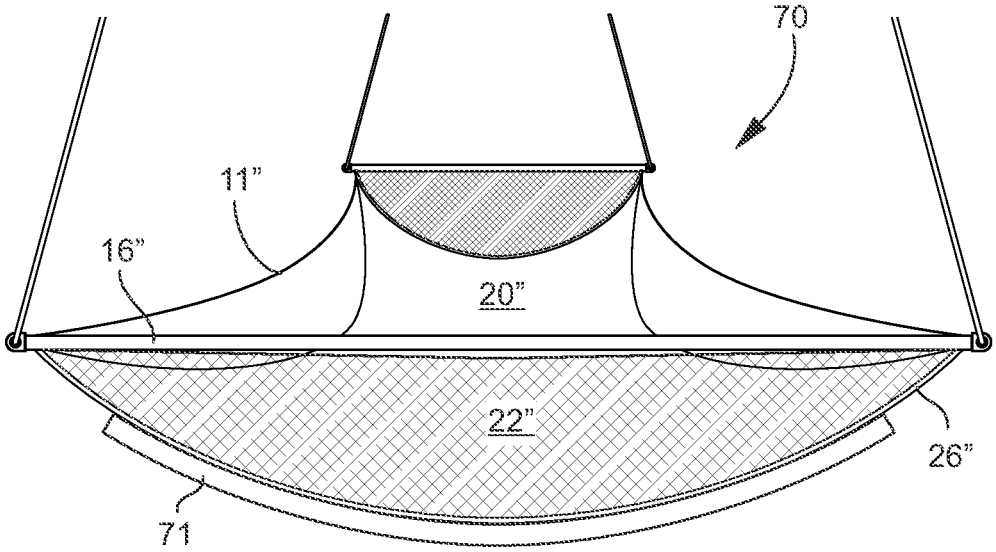
FIGS. 15 and 16 illustrate a third exemplary embodiment of the present convertible hammock assembly.
Figure 16:
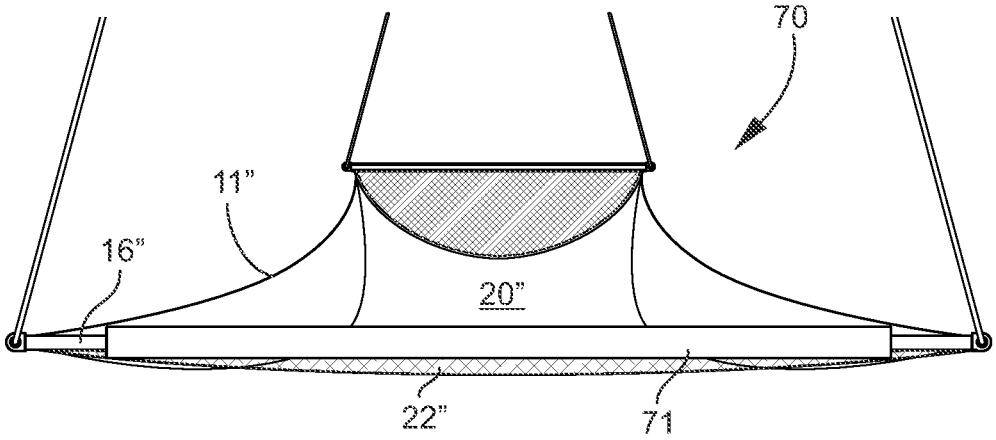

A third embodiment of the exemplary hammock assembly 70 is disclosed in FIGS. 15 and 16. Like elements described above with reference to the hammock assembly 10 are indicated below and in the drawings in double prime notation ("). In this alternative embodiment, the means for selectively laterally tensioning the fabric bed 20" at the head end spreader bar 16" includes an open-ended hem 71 formed along the bottom edge 26" of the end panel 22". When the spreader bar 16" is removed from the bottom hem 71, as shown in FIG. 15, the hammock assembly 70 is loosely tensioned at the head end 12" of the fabric bed 20", such that the hammock 11" resides in a normal generally flat-lying form. By reconfiguring the hammock assembly 70 to insert the spreader bar 16" through the bottom hem 71, as shown in FIG. 16, the bed tension at the spreader bar 16" increases thereby converting the hammock assembly 70 from its generally flat-lying form to a generally inclined form.

Figure 17:
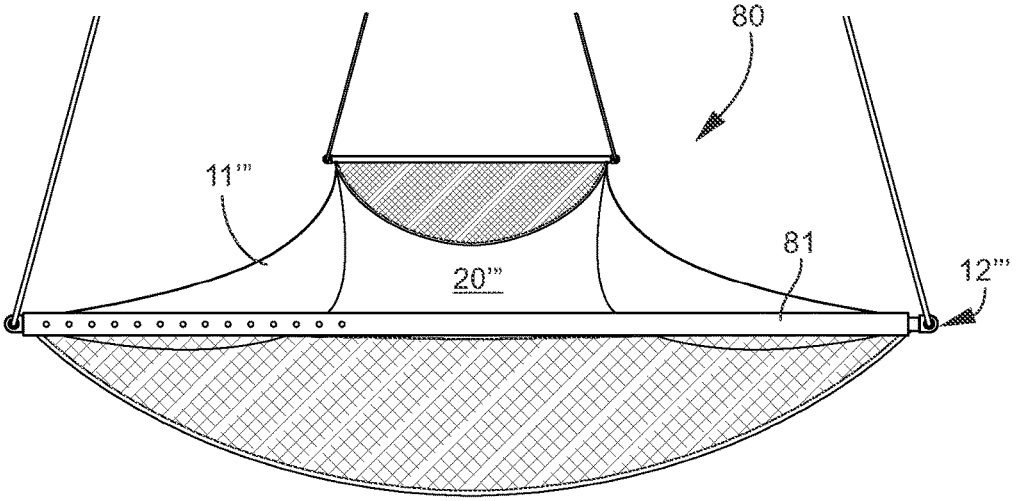
FIGS. 17 and 18 illustrate a fourth exemplary embodiment of the present convertible hammock assembly.
Figure 18:
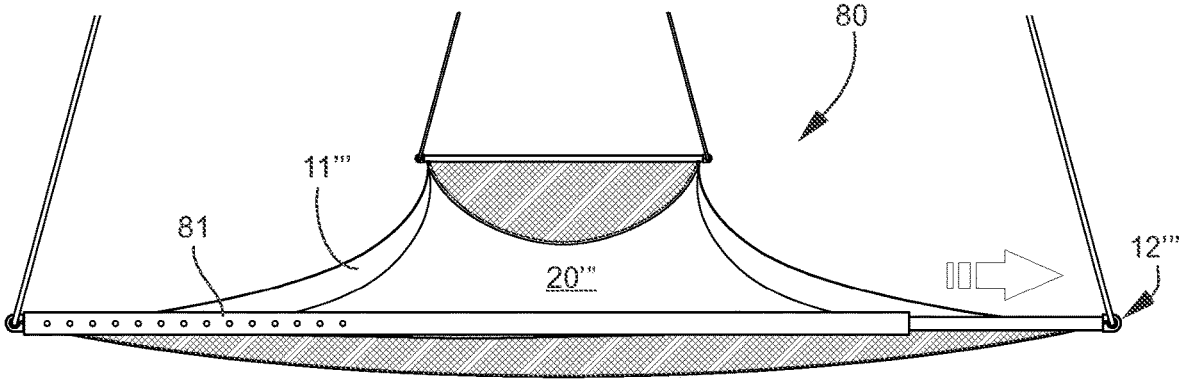

A fourth embodiment of the exemplary hammock assembly 80 is disclosed in FIGS. 17 and 18. Like elements described above with reference to the hammock assembly 10 are indicated below and in the drawings in triple prime notation (u). In this alternative embodiment, the means for selectively laterally tensioning the fabric bed 20''' at the head end of hammock 11" includes a length-adjustable (e.g., telescoping) spreader bar 81. When the spreader bar 81 is in a retracted condition, as shown in FIG. 17, the hammock assembly 80 is loosely tensioned at the head end 12''' of the fabric bed 20''', such that the hammock 11' resides in a normal generally flat-lying form. By extending the spreader bar 81, as shown in FIG. 16, the bed tension at the spreader bar 81 increases thereby converting the hammock assembly 80 from its generally flat-lying form to a generally inclined form. The exemplary spreader bar 81 may comprise multiple telescoping sections with one or more spring-loaded detents and longitudinally-spaced holes enabling ready and convenient length adjustment.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112(f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A convertible hammock assembly, comprising:

a flexible hammock comprising a fabric bed having opposing ends and opposing sides, and suspension lines extending from the opposing ends of said fabric bed for hanging said flexible hammock between spaced apart structures;

an elongated rigid spreader bar located at one end of said fabric bed; and a flexible conversion cord secured to said fabric bed, and having first and second free ends extending through respective caps located at opposite ends of said spreader bar, whereby pulling the free ends of said conversion cord outwardly from said fabric bed converts said flexible hammock from a generally flat condition with reduced lateral bed tension at said spreader bar to a generally inclined condition with increased lateral bed tension at said spreader bar;

a guide fixed to said hammock suspension line adjacent said spreader bar, and defining a guide opening slidably receiving said conversion cord;

cord fasteners located at respective free ends of said conversion cord, and adapted for being attached to respective loops formed with said hammock suspension lines; and first and second release handles spaced apart from respective cord fasteners for pulling said conversion cord inwardly towards said fabric bed, thereby reducing the lateral bed tension at said spreader bar such that said flexible hammock converts back to its generally flat condition.

2. The convertible hammock assembly according to claim 1, and comprising a second guide fixed to said conversion cord adjacent the free end, and defining a guide opening slidably receiving said hammock suspension line.

3. The convertible hammock assembly according to claim 1, wherein said fabric bed comprises a ripstop fabric.

4. The convertible hammock assembly according to claim 1, and comprising a second elongated rigid spreader bar located at the opposite end of said fabric bed.

* * * * *